US005174723A

United States Patent [19]

Gröger et al.

[11] Patent Number: 5,174,723

[45] Date of Patent: Dec. 29, 1992

[54] HIGH-PRESSURE CLEANING APPLIANCE

[75] Inventors: Betram Gröger, Leutenbach; Helmut Komp, Backnang; Rudi Schwaderer, Leutenbach, all of Fed. Rep. of Germany

[73] Assignee: Alfred Karcher GmbH & Co., Winnenden, Fed. Rep. of Germany

[21] Appl. No.: 730,785

[22] PCT Filed: Jan. 4, 1990

[86] PCT No.: PCT/EP90/00009

§ 371 Date: Jul. 24, 1991

§ 102(e) Date: Jul. 24, 1991

[87] PCT Pub. No.: WO90/08602

PCT Pub. Date: Aug. 9, 1990

[30] Foreign Application Priority Data

Jan. 26, 1989 [DE] Fed. Rep. of Germany ..... 3902252

[51] Int. Cl.[5] ..... F04B 49/08

[52] U.S. Cl. ..... 417/26; 417/43; 417/34

[58] Field of Search ..... 417/43, 34, 26, 29

[56] References Cited

U.S. PATENT DOCUMENTS

| | | | |
|---|---|---|---|
| 3,977,603 | 8/1976 | Magee, Jr. . | |
| 4,238,073 | 12/1980 | Liska | 417/34 |
| 4,353,336 | 10/1982 | Mowbray | 417/462 |
| 4,527,953 | 7/1985 | Baker et al. . | |
| 4,545,740 | 10/1985 | Nishikiori et al. . | |
| 5,035,580 | 7/1991 | Simonette | 417/34 |

FOREIGN PATENT DOCUMENTS

| | | |
|---|---|---|
| 504843 | 5/1952 | Belgium . |
| 542445 | 1/1932 | Fed. Rep. of Germany . |
| 8128510 | 4/1982 | Fed. Rep. of Germany . |
| 3443354 | 5/1986 | Fed. Rep. of Germany . |

*Primary Examiner*—Richard A. Bertsch
*Assistant Examiner*—David W. Scheuermann
*Attorney, Agent, or Firm*—Barry R. Lipsitz

[57] ABSTRACT

In a high-pressure cleaning appliance comprising a high-pressure pump driven by an internal combustion engine, a bypass line leading from the pressure line of the pump to the intake side of the pump and opening when the pressure line is closed, and a pressure sensor in the pressure line, in order to adapt the power of the internal combustion engine to the prevailing operating conditions, it is proposed that the pressure sensor reduce the speed of the internal combustion engine immediately the pressure in the pressure line drops below a certain value.

7 Claims, 1 Drawing Sheet

HIGH-PRESSURE CLEANING APPLIANCE

Figure 1:
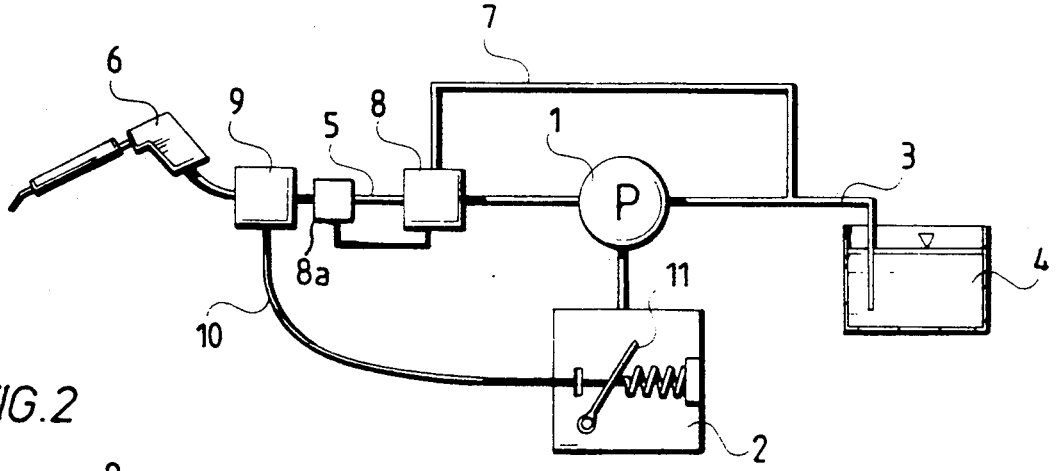

The invention relates to a high-pressure cleaning appliance comprising a high-pressure pump driven by an internal combustion engine, a bypass line leading from the pressure line of the pump to the intake side of the pump and opening when the pressure line is closed, and a pressure sensor in the pressure line.

The high-pressure pump of high-pressure cleaning appliances designed for mobile operation is often driven by an internal combustion engine. When the spray line is open, the internal combustion engine drives the pump with the power required for operation. Closure of the spray gun of the high-pressure pump would result in intensive heating-up of the pump which no longer has any liquid flowing through it.

For this reason, it is known to provide high-pressure cleaning pumps with a bypass which leads back from the pressure line to the intake side of the pump when the pressure line is closed so that the pump then conveys liquid in a circuit. The power required by the pump for this bypass mode is considerably lower than the power required for normal operation. The object of the invention is to so improve a high-pressure cleaning appliance of the generic kind that the power fed to the pump by the internal combustion engine is automatically reduced when the pressure line is closed.

This object is accomplished in a high-pressure cleaning appliance of the kind described at the beginning in accordance with the invention by the pressure sensor reducing the speed of the internal combustion engine immediately when the pressure in the pressure line drops below a certain value, and by a flow monitor being arranged in the pressure line to open the bypass line when there is an absence of flow.

A drop in the pressure in the pressure line occurs when the bypass line is opened so that by way of the reduction in the speed of the internal combustion engine a reduction in the power transmitted to the pump is thereby also automatically achieved. Conversely, the pressure in the pressure line rises again when the bypass line is closed as a result of the pressure drop occurring initially when the spray gun is opened. This rise in pressure then leads via the pressure sensor to a rise in the speed of the internal combustion engine again and hence to transmission of the power required for normal operation to the high-pressure pump. It is very advantageous that the opening and closing of the bypass line is controlled in dependence upon the flow by a flow sensor which detects the flow in the pressure line. Once the flow through the pressure line stops owing to closure of the spray gun, the bypass line is opened, once the flow through the pressure line recommences owing to opening of the spray gun, the bypass line is immediately closed. This immediate closing and opening of the bypass line in dependence upon the flow in the pressure line promotes the pressure changes in the pressure line and hence the change in speed of the internal combustion engine.

It is already known per se from U.S. Pat. No. 3,977,603 to control the speed of an internal combustion engine in dependence upon the pressure of the liquid conveyed, but there is no indication in the known system that the liquid conveyed in the idle mode is to be conducted in a bypass line. Hence corresponding control means, in particular a flow monitor for opening and closing the bypass line, are also missing.

It is also advantageous that a corresponding reduction of the speed occurs not only upon closure of the spray gun and the resulting opening of the bypass line, but also in the event of unforeseen disturbances, for example, if the high-pressure tube should burst or be torn off, as, in this case, too, the pressure prevailing in the pressure line drops below the pressure necessary for the reduction of the speed.

It is particularly advantageous for the pressure sensor to adjust the throttle lever system of the internal combustion engine in the direction towards an increase in the speed when the certain pressure value is exceeded. This intervention in the throttle lever system of the internal combustion engine makes it possible for the internal combustion engine to otherwise be operated with its own regulating system which is not interferred with. This also makes it possible, in a simple way, for an internal combustion engine to be subsequently equipped with a corresponding speed regulating system as it is sufficient to add a corresponding actuating element for adjusting the throttle lever system in dependence upon the position of the pressure sensor.

It is preferable for the pressure sensor to actuate a Bowden cable which engages the throttle lever system.

In a preferred embodiment, the pressure sensor comprises a control piston which is acted upon by the pressure in the pressure line and is displaceable against the force of a spring. Its motion is transferred to the motion of the throttle lever system. Provision may be made for the control piston to be a step piston which is displaceable in a sealed-off manner in a cylindrical housing and for a measurement line which communicates with the pressure line to open into the annular space formed between piston and cylindrical housing.

One thereby obtains a particularly compact component which can be readily connected also subsequently to a pressure line of a high-pressure cleaning appliance, and with the transmission of the piston position to the throttle lever system via a Bowden cable a construction has been found which is mechanically stable and unsusceptible to failure.

Figure 2:
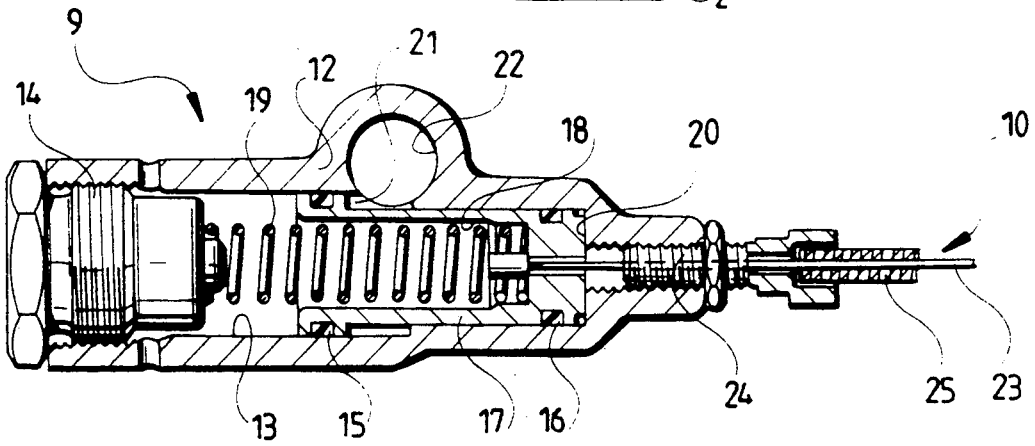
Figure 3:
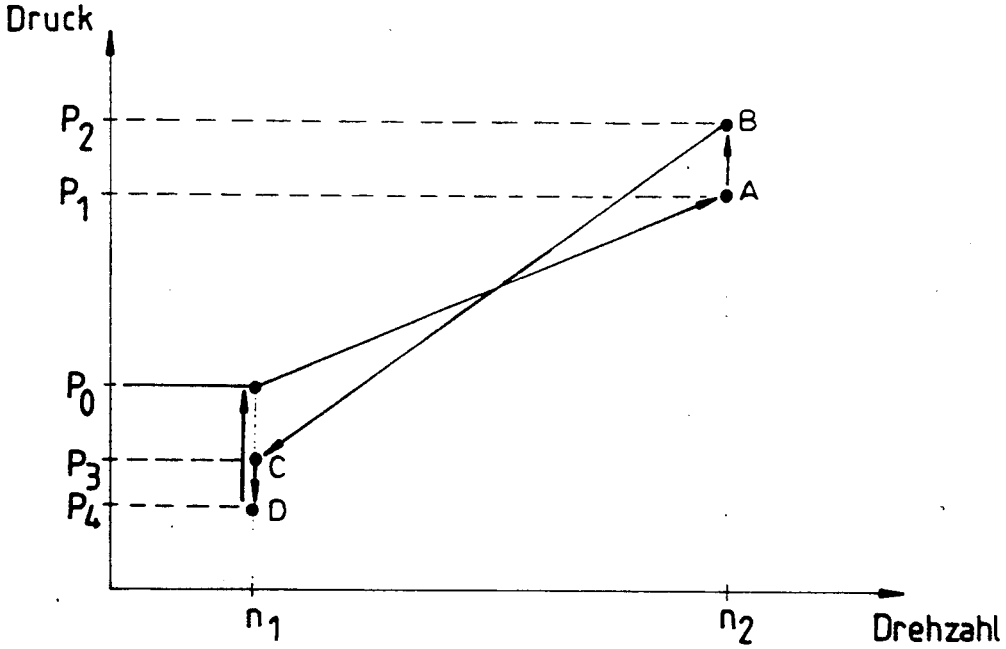

The following description of a preferred embodiment serves in conjunction with the drawings to explain the invention in further detail. The drawings show:

FIG. 1 a schematic illustration of a high-pressure cleaning appliance with an internal combustion engine, the speed of which is controlled in dependence upon the pressure;

FIG. 2 a longitudinal sectional view of a pressure sensor for actuating a Bowden cable; and FIG. 3 a schematic illustration of the course of the pressure on the pressure sensor and the thereby adjusted speeds of the internal combustion engine.

A high-pressure cleaning appliance, as illustrated schematically in FIG. 1, comprises a high-pressure pump 1 which is driven by an internal combustion engine 2. The intake line 3 of the high-pressure pump communicates with a supply tank 4 or another feed line; the pressure line 5 of the high-pressure pump 1 leads to a closable spray gun 6.

A bypass line 7 which leads back to the intake line 3 of the high-pressure pump 1 branches off from the pressure line 5. The bypass line 7 is normally closed by means of a closure valve 8, but it is opened when the pressure line 5 is closed, for example, by letting go of the spray gun 6. This can be controlled by a flow monitor 8*a*, in the pressure line or by pressure difference measurements in constrictions of the pressure line. It is thereby ensured in a manner known per se that when the spray gun is closed, the liquid conveyed by the pump is conducted through the bypass line back to the intake side of the pump and hence is only conveyed in a circuit by the pump, whereas the liquid is fed directly to the spray gun when the spray gun is open and, consequently, the bypass line is closed.

The pressure line 5 also contains a pressure sensor 9 which is connected via a Bowden cable 10 to the throttle lever 11 of the internal combustion engine 2 and by actuation of the Bowden cable 10 moves the throttle lever 11 from a low-speed position into a high-speed position and vice-versa.

A preferred embodiment of such a pressure sensor 9 is illustrated in FIG. 2. This pressure sensor 9 comprises a housing 12 with a stepped blind-hole bore 13 which is closed by a threaded plug 14. A step piston 17 is mounted for longitudinal displacement in the blind-hole bore 13 and is sealed off from the inside wall of the latter by gaskets 15 and 16. The step piston 17 receives in a front-hole bore 18 a compression spring 19 which is supported at its other end on the threaded plug 14 and hence presses the step piston 17 against the bottom 20 of the blind-hole bore 13.

Owing to the stepped design of both the blind-hole bore 13 and the step piston 17 there is between the step piston 17, on the one hand, and the inside wall of the blind-hole bore 13, on the other hand, a sealed-off annular space 21 which communicates with a measurement opening 22 attached to the wall and extending transversely through the housing. This can be connected via a measurement line, not illustrated in the drawing, to the pressure line 5; it is also possible to connect this measurement opening 22 directly in the pressure line 5.

Owing to the connection of the measurement opening 22 with the annular space 21, the latter is filled with the liquid conveyed through the pressure line 5 and when the pressure rises, the liquid removes the step piston 17 from the bottom 20 of the blind-hole bore 13 against the action of the compression spring 19.

The core 23 of the Bowden cable 10 is held on the step piston 17. It leaves the bottom 20 of the blind-hole bore 13 through a screwed-in threaded sleeve 24 and is guided in a spriral jacket 25 supported on the threaded sleeve 24 as far as the throttle lever 11. The spiral jacket 25 is supported at its other end on a stop on the internal combustion engine 2.

When the step piston 17 is displaced under the effect of the liquid conveyed in the pressure line 5, the core 23 of the Bowden cable 10 is displaced relative to the spiral jacket 25, with the result that the throttle lever of the internal combustion engine 2 and hence the speed of the latter are also adjusted.

The pressures which occur are explained hereinbelow with reference to the illustration in FIG. 3. During normal operation (position A) the liquid conveyed through the pressure line is at a pressure $P_1$. This is so great that the step piston is displaced against the action of the compression spring, the throttle lever 11 of the internal combustion engine is thereby moved out of the idle position, the internal combustion engine operates at a high speed $n_2$.

When the spray gun 6 is closed, the pressure in the pressure line 5 rises for a short time to the higher pressure value $P_2$ until the bypass line 7 is opened as a result of the absence of flow in the pressure line. This opening of the bypass line 7 causes the pressure in the pressure line to drop to the lower value $P_3$ (working point C). This pressure is so low that the compression spring 19 pushes the step piston 17 back into the initial position so that the throttle lever 11 of the internal combustion engine moves via the Bowden cable 10 into the idle position and the engine now runs at the low speed $n_1$.

If the spray gun 6 is opened again from this position of rest, the pressure in the pressure line first drops further to the value $P_4$ (position D) but liquid is now flowing through the pressure line again so that the bypass line is closed again owing to this flow of liquid. As a result of this, the pressure rises to the higher value $P_0$ at which displacement of the step piston 17 in the pressure sensor 9 and hence increase of the speed of the internal combustion engine commences. Owing to the activity of the pump, the pressure in the liquid is increased to the operating pressure P1, and the speed of the engine rises continuously to the maximum value $n_2$ and reaches the initial working point A again.

In this embodiment it is particularly advantageous that regulation of the speed is possible by actuation of the throttle lever system of the internal combustion engine without having to interfere with the internal regulation of the engine.

In the present case, the pressure in the pressure line is detected by a mechanically operating pressure sensor which transmits the motion of the control piston directly via a Bowden cable to the engine. It is, of course, possible to select other means of transmission instead of the Bowden cable, for example, hydraulic transmission or electric transmission using an electric pressure sensor.

We claim:

1. A high-pressure cleaning appliance comprising a high-pressure pump driven by an internal combustion engine, a bypass line leading from a pressure line of said pump to an intake side of said pump and opening when said pressure line is closed, and a pressure sensor in said pressure line, wherein said pressure sensor reduces the speed of said internal combustion engine immediately when the pressure in said pressure line drops below a certain value, and wherein a flow monitor is arranged in said pressure line to open said bypass line when there is an absence of flow.

2. A high-pressure cleaning appliance as defined in claim 1, wherein when a certain pressure value is exceeded, said pressure sensor adjusts a throttle lever system of said internal combustion engine in a direction towards an increase in the speed.

3. A high-pressure cleaning appliance as defined in claim 2, wherein said pressure sensor actuates a Bowden cable engaging said throttle lever system.

4. A high-pressure cleaning appliance as defined in claim 2, wherein said pressure sensor comprises a control piston which is acted upon by the pressure in said pressure line and is displaceable against the force of a spring and the motion of which is transferred to the motion of said throttle lever system.

5. A high-pressure cleaning appliance as defined in claim 4, wherein said control piston is a step piston displaceable in a sealed-off manner in a cylindrical housing, and wherein a measurement line communicating with said pressure line opens into an annular space formed between the piston and the cylindrical housing.

6. A high-pressure cleaning appliance as defined in claim 3, wherein said pressure sensor comprises a control piston which is acted upon by the pressure in said pressure line and is displaceable against the force of a spring and the motion of which is transferred to the motion of said throttle lever system.

7. A high-pressure cleaning appliance as defined in claim 6, wherein said control piston is a step piston displaceable in a sealed-off manner in a cylindrical housing, and wherein a measurement line communicating with said pressure line opens into an annular space formed between the piston and the cylindrical housing.

* * * * *